US006575779B1

(12) United States Patent
Nagai et al.

(10) Patent No.: US 6,575,779 B1
(45) Date of Patent: Jun. 10, 2003

(54) PRESSURE-CONTACT TERMINAL

(75) Inventors: Kentaro Nagai, Shizuoka-ken (JP); Junko Ishida, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/696,243

(22) Filed: Oct. 26, 2000

(30) Foreign Application Priority Data

Nov. 8, 1999 (JP) ..... 11-317368

(51) Int. Cl.[7] ..... H01R 4/24
(52) U.S. Cl. ..... 439/397; 439/400
(58) Field of Search ..... 439/395, 396, 439/397, 400, 401, 406, 407, 399

(56) References Cited

U.S. PATENT DOCUMENTS

RE31,132 E * 1/1983 Hoppe, Jr. ..... 439/397
5,934,928 A * 8/1999 Endo et al. ..... 439/397
6,113,417 A * 9/2000 Furutani et al. ..... 439/397
6,142,819 A * 11/2000 Norizuki et al. ..... 439/397

FOREIGN PATENT DOCUMENTS

JP 9-274941 10/1997
JP 10-261442 9/1998

* cited by examiner

*Primary Examiner*—Hien Vu
(74) *Attorney, Agent, or Firm*—Finnegan, Henderson, Farabow, Garrett & Dunner, L.L.P.

(57) ABSTRACT

A pressure-contact terminal includes: a contact portion (21); and a pressure-contact portion (32) which has a bottom plate, a pair of side plates formed by bending from the bottom plate in the same direction, and at least a pair of pressure-contact plates (34, 35) formed to stand from the pair of side plates above the bottom plate and to face each other. In the construction, the pressure-contact plates (34, 35) include: electric wire contact portions (34A, 35A) formed by bending which have contact faces (34G, 35G) to be in contact with a core of a covered electric wire; and cover cutting-off portions (34B, 35B ) formed on upper portions of the electric wire contact portions (34A, 35A ) to cut and remove the cover portion of the covered electric wire.

2 Claims, 5 Drawing Sheets

PRESSURE-CONTACT TERMINAL

BACKGROUND OF THE INVENTION

1. Field of the Invention

The present invention relates to a pressure-contact terminal formed with pressure-contact blades between which an end of an electric wire is press-fitted.

2. Description of the Related Art

Conventionally, there is a known pressure-contact terminal of this type as disclosed in Japanese Patent Application Laid-open No. 10-261442 as shown in FIGS. 1 and 2. As shown in FIG. 1, a pressure-contact terminal 1 is formed at its one side with a contact portion 2 for connection to an opposed terminal and at its the other side with an electric wire connecting portion 3 for retaining an electric wire and for connection to the electric wire. The electric wire connecting portion 3 is formed with pressure-contact plate portions 6, 7, 8, and 9 cut and bent inward from a pair of side walls 4 and 5. The electric wire connecting portions 3 is formed at its end portion with a pair of electric wire retaining chips 10 and 11.

FIG. 2 is an enlarged perspective view of the pressure contact plate portion 9. As shown in FIG. 2, the pressure-contact plate portion 9 is formed at its tip end with a pressure-contact blade 12 bent toward the contact portion 2. The pressure-contact blade 12 is formed on its tip end side with a thin portion 13 with a small thickness and the thin portion 13 is bent to form an angle of 90° to form a contact face 14 on an outer peripheral face of the thin portion 13. The other pressure-contact plate portions 7, 8, and 9 are also formed with pressure-contact blades respectively and are formed with thin portions and pressure-contact faces similarly to the pressure-contact plate portion 9.

By the pressure-contact terminal 1 with such a structure, by press-fitting a covered electric wire in the electric wire connecting portion 3, the pressure-contact blades 12 cut the cover to bring the contact faces 14 into contact with a core, thereby establishing connection.

However, because the contact face 14 is formed by bending the thin portion 13 in the above-described pressure-contact terminal 1, the contact face 14 has low strength and may be deformed in coming into pressure contact with the electric wire.

Furthermore, because a bent portion formed by bending the thin plate portion exists on an upper side of the contact face, cut opposite sides of the cover portion may not be removed to portions other than the contact faces and may remain on the contact face sides after cutting the cover portion. In this case, there is doubt about reliability of connection between the contact faces and the core portion.

SUMMARY OF INVENTION

The present invention has been achieved with such points in mind.

It therefore is an object of the present invention to provide a pressure-contact terminal by which a cover of an electric wire can be reliably removed and electric connection with the electric wire can be reliably established.

According to a first aspect of the invention, there is provided a pressure-contact terminal, comprising: a contact portion (21) in contact with an opposed terminal and formed on a tip end side of the pressure-contact terminal; and a pressure-contact portion (32) formed on a rear end side of the pressure-contact terminal, the pressure-contact portion (32) having a bottom plate, a pair of side plates formed by bending from the bottom plate in the same direction, and at least a pair of pressure-contact plates (34, 35 . . . ) formed to stand from the pair of side plates above the bottom plate and to face each other; wherein the pressure-contact plates (34, 35 . . . ) include: electric wire contact portions (34A, 35A . . . ) formed by bending thin plate portions formed at tip ends of the pressure-contact plates, the electric wire contact portions (34A, 35A . . . ) having contact faces (34G, 35G . . . ) to be in contact with a core of a covered electric wire; and cover cutting-off portions (34B, 35B . . . ) formed on upper portions of the electric wire contact portions (34A, 35A . . . ) to cut and remove the cover portion of the covered electric wire.

In the invention with such a structure, the cover portion of the covered electric wire is cut and removed by the cover cutting-off portions when the covered electric wire is inserted between the pair of pressure-contact plates. By inserting the covered electric wire between the pair of pressure-contact plates, the electric wire contact portions are brought into contact with the core portion of the covered electric wire to connect the pressure-contact terminal and the covered electric wire. In this case, because the core portion comes in contact with the contact faces after the cover cutting-off portions have reliably cut off the cover portion, electric reliability in connection is improved. Because the contact faces are plated, conductivity is further improved, thereby improving the electric reliability in connection.

According to a second aspect of the invention as it depends from the first aspect, in addition to an arrangement of the first aspect, there is provided a pressure-contact terminal, wherein the cover cutting-off portions (34B, 35B . . . ) include: cutting slopes (34E, 35E . . . ) for guiding the covered electric wire to between the pair of pressure-contact plates (34, 35 . . . ) facing each other and for cutting the cover of the covered electric wire; and removing portions (34F, 35F . . . ) formed on tip end sides of the cutting slopes (34E, 35E . . . )to remove the cover portion cut by the cutting slopes to opposite side portions of the pressure-contact plates; and wherein the removing portions (34F, 35F . . . ) include: cover separating faces (34H, 35H . . . ) for separating the cut cover portions to the opposite side portions of the pressure-contact plates (34, 35 . . . ); and cutting-off edge portions (34I, 35I . . . ) formed at continuous portions from the cover separating faces (34H, 35H . . . ) and the cutting slopes (34E, 35E . . . ) to divide the cut opposite cover portions.

Therefore, when the covered electric wire is inserted between the pair of pressure-contact plates, the covered electric wire is guided to between the pressure-contact plates by the cutting slopes and the cover portion is cut and moves to the removing portions. At the removing portions, the opposite sides of the cut cover portion are divided by the cover edge portions and reliably separated to the opposite side portions of the pressure-contact plates by the cover separating faces. Thus, it is possible to reliably remove the cover portion of the covered electric wire and to reliably bring the core portion into contact with the contact faces.

According to a third aspect of the invention as it depends from the first aspect or the second aspect, in addition to an arrangement of the first aspect or the second aspect, there is provided a pressure-contact terminal, wherein the electric wire contact portions (34A, 35A . . . ) include: bent portions (34C, 35C . . . ) formed by bending thin plate portions formed at tip ends of the pressure-contact plates land formed with the contact faces (34G, 35G . . . . ) to be connected in a conductive manner to the covered electric wire; and folded portions (34D, 35D . . . ) formed by further folding tip ends of the bent portions (34C, 35C . . . ) toward the bent portions (34C, 35C . . . ).

Therefore, strength of the bent portions is maintained by the folded portions and contact property of the contact faces formed on the bent portions with the core is ensured to reliably establish electric connection.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF PREFERRED EMBODIMENT

Figure 1:
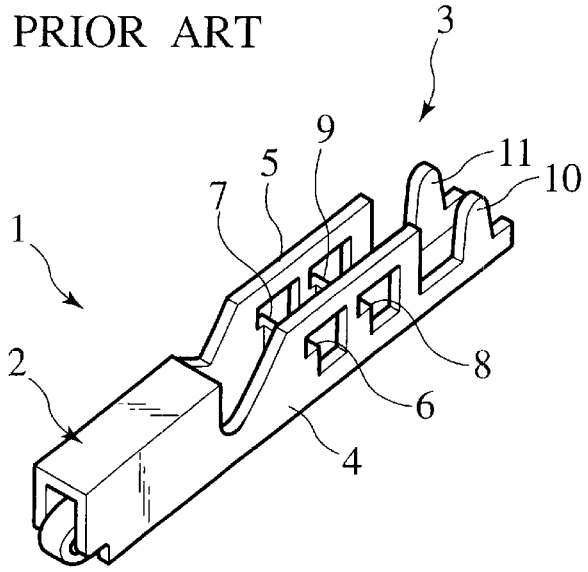
FIG.1 PRIOR ART
FIG. 1 is a perspective view of a prior-art pressure-contact terminal.
Figure 2:
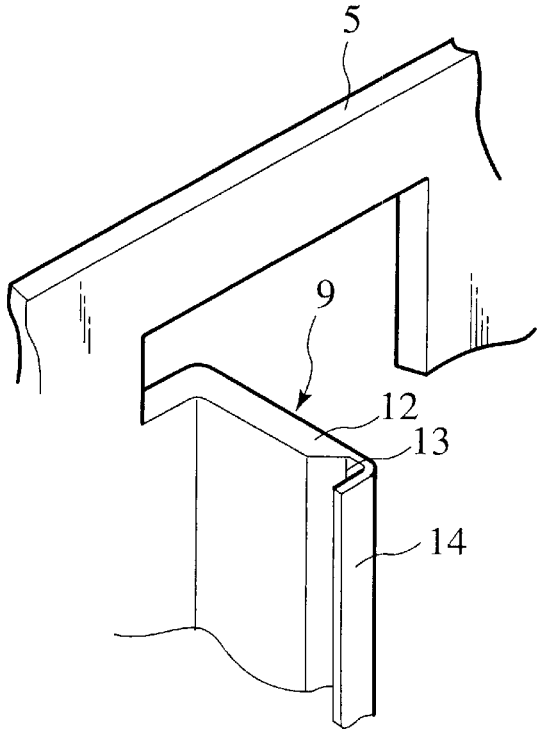
FIG.2 PRIOR ART
FIG. 2 is an enlarged perspective view of an essential portion of the prior-art pressure-contact terminal.
Figure 3:
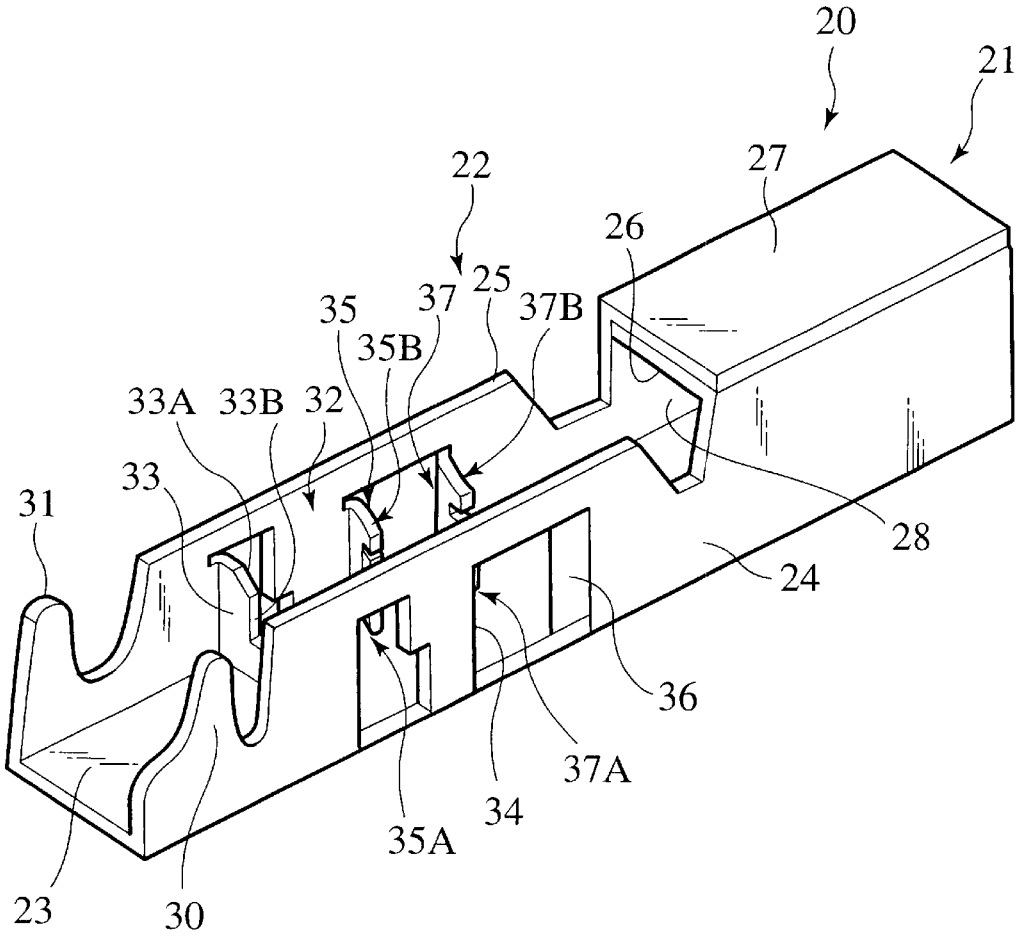
FIG. 3 is a perspective view of an embodiment of a pressure-contact terminal according to the present invention.
Figure 4:
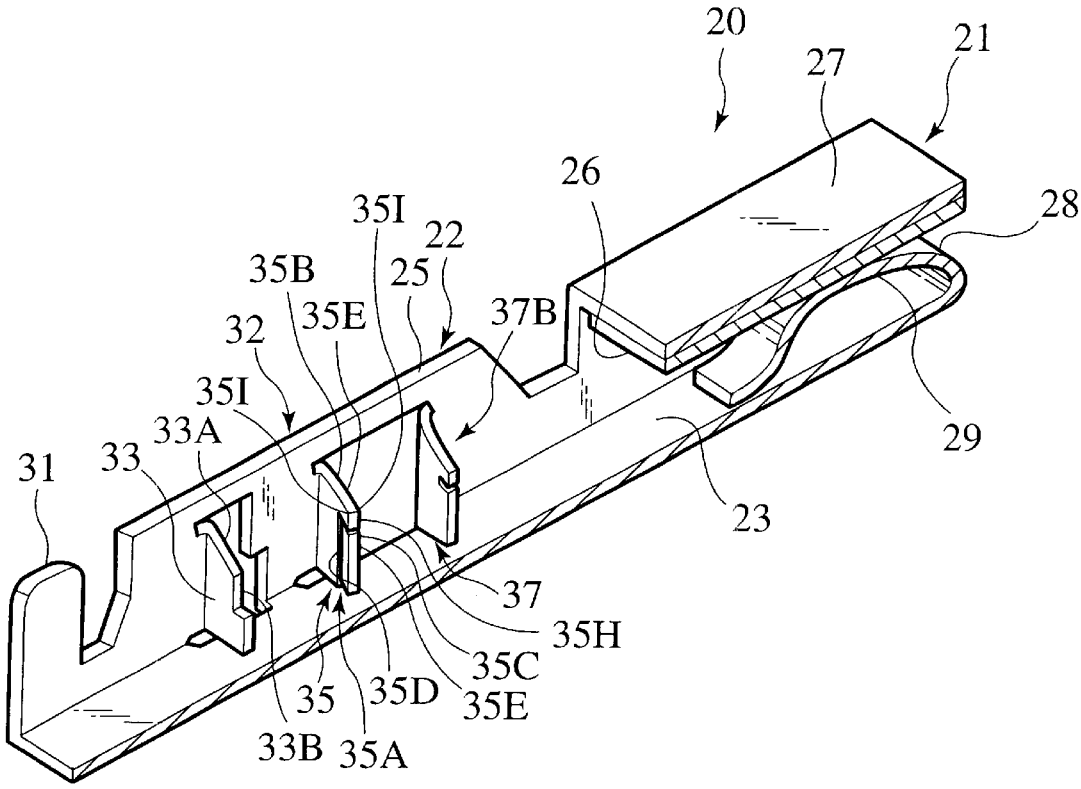
FIG. 4 is a partial sectional perspective view showing a vertical section of the pressure-contact terminal of the embodiment.

A detail of a pressure-contact terminal according to the present invention will be described below based on an embodiment shown in the drawings. FIG. 3 is a perspective view of the pressure-contact terminal 20 of the present embodiment and FIG. 4 is a sectional perspective view of the pressure-contact terminal 20 that is cut away at a center in a width direction. As shown in FIGS. 3 and 4, the pressure-contact terminal 20 is formed on its front end side with a contact portion 21 to be in contact with an opposed terminal and on its rear end side with an electric wire connecting portion 22. The pressure-contact terminal 20 of the embodiment is formed by bending a sheet of metal plate in a necessary developed shape, the metal plate being obtained by die-cutting a metal plate plated on its front and back faces.

The contact portion 21 and the electric wire connecting portion 22 are formed along a common bottom plate 23. Side plates 24 and 25 standing to be perpendicular to the bottom plate 23 are formed on opposite side edges in a width direction of the bottom plate 23. The side plates 24 and 25 face each other in parallel to each other.

The contact portion 21 includes top plates 26 and 27 respectively extending from upper edges of the side plates 24 and 25, the top plates 26 and 27 being bent such that one is placed on the other. A contact spring chip 29 extending from a front end edge of the bottom plate 23 toward a rear end side is housed and disposed in a cavity 28, surrounded by the bottom plate 23, the side plates 24 and 25, and the top plates 26 and 27. The contact spring chip 29 is curved toward the top plate 26 side and presses and pinches the opposed terminal against an inner face of the top plate 26 to establish electric connection when the opposed terminal is press-fitted from a front end side of the contact portion 21.

The electric wire connecting portion 22 is formed on its rear end side with a pair of electric wire retaining chips 30 and 31. The electric wire connecting portion 22 is formed on a front end side of the electric wire retaining chips 30 and 31 with a pressure-contact portion 32. The pressure-contact portion 32 has a pair of electric wire pinching plates 33, 33 formed by cutting and bending the side plates 24 and 25 inward and two pairs of pressure-contact plates 34, 35, 36, and 37 formed by cutting and bending the side plates 24 and 25 inward on the front end side of the electric wire pinching plates 33, 33. The pressure-contact plates 34 and 35 face each other to pair up with each other and the pressure-contact plates 36 and 37 similarly pair up with each other.

The electric wire pinching plate 33 has at its upper portion a guide slope 33A for guiding a covered electric wire to an inside and has a pinching face 33B extending from an end portion of the guide slope 33A toward the bottom plate 23. Although FIG. 3 shows the electric wire pinching plate 33 on the side plate 25 side only, the electric wire pinching plate 33 on the side plate 24 side has a similar shape.

Next, structures of the pressure-contact plates 34, 35, 36, and 37 will be described. Because the pressure-contact plates 34 and 36 formed on the side plate 24 have similar structures to the pressure-contact plates 35 and 37 formed on the side plate 25, the structures of the pressure-contact plates 35 and 37 on the side plate 25 will be described and description of the pressure-contact plates 34 and 36 will be omitted.

Figure 5:
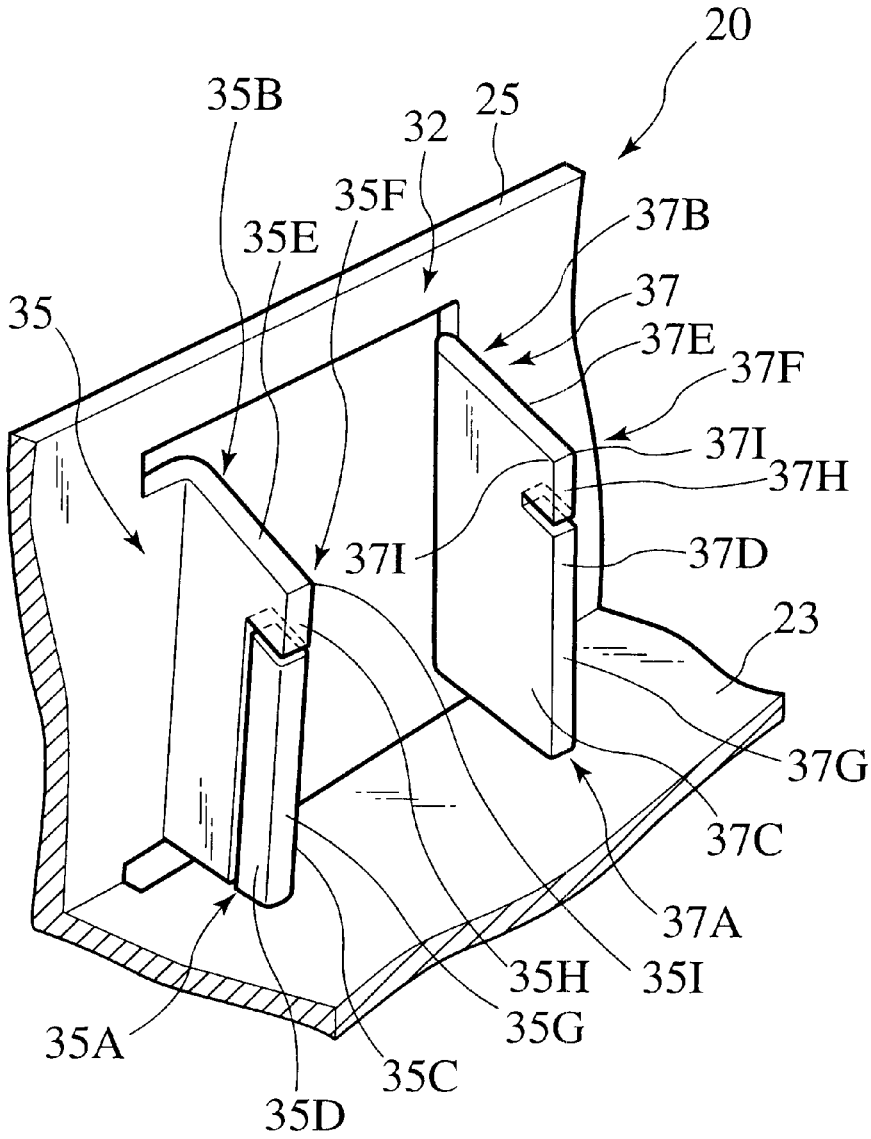
FIG. 5 is an enlarged cutaway perspective view of an essential portion of the pressure-contact terminal of the embodiment.

As shown in FIG. 5, the pressure-contact plates 35 and 37 are formed by bending portions of the side plate 25 cut to be opened sideways in opposite directions such that the portions are opened inward (toward an inner side of the pressure-contact terminal) to be substantially perpendicular to the side plate 25.

The pressure-contact plates 35 and 37 are formed by folding back thin plate portions provided on tip end sides of the pressure-contact plates 35 and 37 and are plated. The pressure-contact plates 35 and 37 include electric wire contact portions 35A and 37A having contact faces 35G and 37G to be in contact with a core 42 of a covered electric wire 40 and cover cutting-off portions 35B and 37B provided to upper portions of the electric wire contact portions 35A and 37A to cut and remove a cover portion 41 of the covered electric wire 40.

The cover cutting-off portions 35B and 37B are formed of cutting slopes 35E and 37E for guiding the covered electric wire 40 to between the pressure-contact portions and cutting the cover portion 41 of the covered electric wire 40 and removing portions 35F and 37F provided on tip end sides of the cutting slopes 35E and 37E to remove the cut opposite cover portions to opposite side portions of the pressure-contact plates 35 and 37.

The removing portions 35F and 37F are formed of cover separating faces 35H and 37H for separating the cut opposite cover portions to the opposite side portions of the pressure-contact plates 35 and 37 and cutting-off edge portions 35I and 37I provided to portions that continue from the cover separating faces 35H and 37H and the cutting slopes 35E and 37E to divide the cut opposite cover portions 41, 41.

The electric wire contact portions 35A and 37A are formed of bent portions 35C and 37C formed by bending the thin plate portions at the tip end portions of the pressure-contact plates 35 and 37 and folded portions 35D and 37D formed by further folding tip end sides of the bent portions 35C and 37C toward the bent portions 35C and 37C. The bent portions 35C and 37C are formed with contact faces 35G and 37G to be connected to the core 42 of the covered electric wire 40 in a conductive manner.

Figure 6:
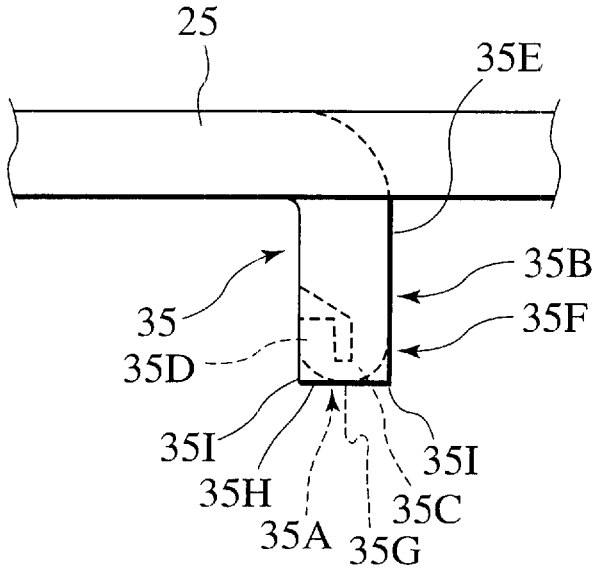
FIG. 6 is a plan view of an essential portion of the pressure-contact terminal of the embodiment.

Thickness of the electric wire contact portions 35A and 37A are set to be substantially the same as widths of the cutting slopes 35E and 37E as shown in FIG. 6. Therefore, a thickness of each of the bent portions 35C, 37C, and the folded portions 35D, 37D constituting the electric wire contact portions 35A and 37A is set at substantially half a thickness of each of the pressure-contact plates 35 and 37 to form the thickness of each of the pressure-contact plates 35 and 37.

Although the structures of the pressure-contact plates 35 and 37 have been described above, the pressure-contact plates 34 and 36 have the similar structures. The pressure-contact plate 34 is symmetric with the pressure-contact plate 35 with respect to a line passing through a midpoint between the pressure-contact plate 34 and the pressure-contact plate 35 and the pressure-contact plate 36 is symmetric with the pressure-contact plate 37 with respect to a line passing through a midpoint between the pressure-contact plate 36 and the pressure-contact plate 37.

The pressure-contact terminal 20 of the embodiment is formed by die-cutting a metal plate into a necessary developed shape, the metal plate being plated in advance, and by bending the metal plate. Thickness of the metal plate portions constituting the electric wire contact portions 35A and 37A are reduced by presswork.

Figure 7:
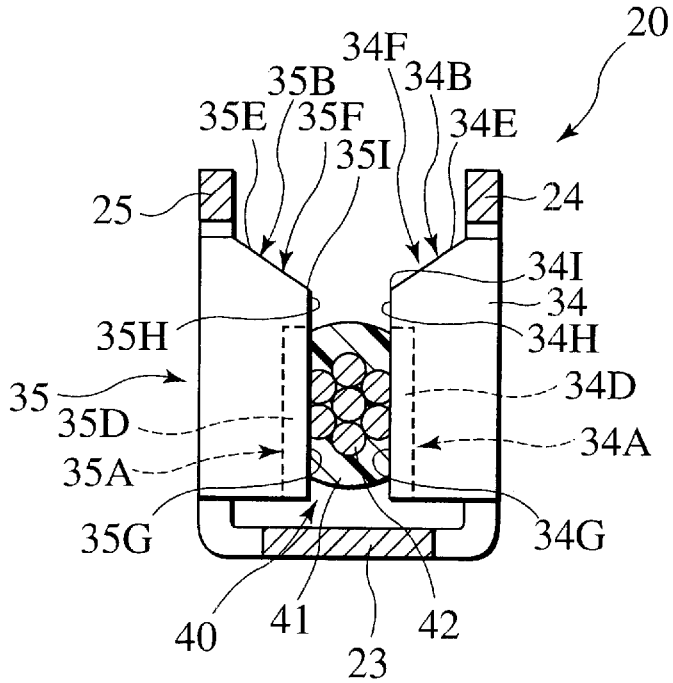
FIG. 7 is a sectional view showing a vertical section in a width direction of a state in which an electric wire is mounted to the pressure-contact terminal of the embodiment.

Next, operation of the pressure-contact terminal 20 of the embodiment on the covered electric wire will be described with reference to FIG. 7. First, an end of the covered electric wire 40 is placed on the electric wire connecting portion 22 and is pressed by using a pressure-contact jig or the like. Then, an outer peripheral face of the cover portion 41 of the covered electric wire 40 is guided by the cutting slopes 34E, 35E, 36E, and 37E and the guide slopes 33A, 33,A and press-fitted between the pressure-contact plates 34 and 35 and between the pressure-contact plates 36 and 37. At this time, the cover portion 41 of the covered electric wire 40 is cut when it slides on the cutting slopes 34E, 35E, 36E, and 37E.

When the covered electric wire 40 is further pressed, opposite sides of the cut cover portion 41 are separated to opposite sides of the pressure-contact plates 34, 35, 36, and 37 by cutting-off edge portions 34I, 35I, 36I, and 37I. Then, the opposite sides of the cut cover portion 41 are removed to the opposite sides of the pressure-contact plates 34, 35, 36, and 37 by the cover separating faces 34H, 35H, 36H, and 37H. At the same time, the exposed core 42 comes in contact with the contact faces 34G, 35G, 36G, and 37G to establish electric contact between the covered electric wire 40 and the pressure-contact terminal 20. In this case, because the contact faces 34G, 35G, 36G, and 317G are plated, the electric contact can be reliably established between the covered electric wire 40 and the pressure-contact terminal 20.

Then, by bending the electric wire retaining chips 30 and 31 formed on the side plates 24 and 25 inward, the pressure-contact terminal 20 can be retained on the covered electric wire 40.

According to the embodiment, because the core 42 comes in contact with the contact faces 34G, 35G, 36G, and 37G after the cover cutting-off portions 34B, 35B, 36B, and 37B have reliably cut the cover portion 41, electric reliability in connection is improved.

Because the contact faces 34G, 35G, 36G, and 37G are plated, conductivity is further improved, thereby improving the electric reliability in connection.

According to the embodiment, strength of the bent portions 34C, 35C, 36C, and 37C are maintained by the folded portions 34D, 35D, 36D, and 37D and contact property of the contact faces 34G, 35G, 36G, and 37G provided to the bent portions 34C, 35C, 36C, and 37C with the core 42 is ensured, thereby reliably establishing electric connection.

Although the embodiment has been described above, the present invention is not limited to the embodiment and various modifications accompanying summary of the structure may be made. For example, although two pairs of pressure-contact plates (34, 35/36, 37) are provided in the above-described embodiment, satisfactory electric connection can be established with a structure including at least a pairs of pressure-contact plates. Although the electric wire pinching chips 33, 33 are provided in the embodiment, it is possible to omit them.

Although the pressure-contact terminal 20 is formed by bending a sheet of metal plate in the developed shape, it is possible to form a plurality of members integrally with the pressure-contact terminal.

The entire contents of Japanese Patent Application P11-317368 (filed on Nov. 8, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A pressure-contact terminal for connecting a wire to an opposed terminal, the pressure-contact terminal comprising:

a contact portion formed on a front end of the pressure-contact terminal; and a pressure-contact portion formed on a rear end of the pressure-contact terminal for providing a reliable electrical connection between a wire having a cover portion and the pressure-contact terminal, the pressure-contact portion having a bottom plate, an opposed, upstanding pair of side plates formed by bending the bottom plate, and an opposed pair of pressure-contact plates projecting inward from the side plates and above the bottom plate;

wherein the pressure-contact plates include cover cutting-off portions formed along obliquely extending upper edge portions of the pressure-contact plates for cutting and removing the cover portion of the wire, and wire-contact portions for contacting a core of the wire, wherein the wire-contact portions comprise:

bent portions formed by bending thin plate portions formed at tip ends of the pressure-contact plates and formed with the contact faces to be connected in a conductive manner to the covered electric wire, and folded portions formed by further folding tip ends of the bent portions toward the bent portions.

2. The pressure-contact terminal according to claim 1, wherein the cover cutting-off portions have cutting slopes for guiding the wire between the pair of pressure-contact plates and for cutting the cover portion of the wire, and removing portions formed on tip end sides of the cutting slopes to remove the cover portion cut by the cutting slopes; and wherein the removing portions have cover separating faces for separating the cut cover portions to the opposite side portions of the pressure-contact plates, and cutting-off edge portions formed intermediate the cover separating faces and the cutting slopes to divide the cut cover portion.

* * * * *